US008129033B2

(12) United States Patent
Tammi

(10) Patent No.: US 8,129,033 B2
(45) Date of Patent: Mar. 6, 2012

(54) COMPOSITION FOR IMPROVING THE PRINTABILITY OF COATED PAPER

(75) Inventor: Anna-Liisa Tammi, Paimio (FI)

(73) Assignee: BASF SE, Ludwigshafen (DE)

( * ) Notice: Subject to any disclaimer, the term of this patent is extended or adjusted under 35 U.S.C. 154(b) by 168 days.

(21) Appl. No.: 12/227,884

(22) PCT Filed: Jun. 6, 2007

(86) PCT No.: PCT/EP2007/004990

§ 371 (c)(1), (2), (4) Date: Mar. 23, 2009

(87) PCT Pub. No.: WO2007/140992

PCT Pub. Date: Dec. 13, 2007

(65) Prior Publication Data

US 2010/0015459 A1 Jan. 21, 2010

(30) Foreign Application Priority Data

Jun. 6, 2006 (EP) ..... 06011610

(51) Int. Cl.
*B32B 7/02* (2006.01)

(52) U.S. Cl. ..... 428/537.5; 428/212; 428/195.1; 428/323; 428/688; 427/384; 427/391; 427/394; 427/395; 101/5; 101/34

(58) Field of Classification Search ..... 428/212, 428/195.1, 323, 537.5, 688; 101/5, 34; 427/384, 427/391, 394, 395

See application file for complete search history.

(56) References Cited

U.S. PATENT DOCUMENTS

| | | | | |
|---|---|---|---|---|
| 5,314,753 | A | 5/1994 | Bergmann | |
| 5,439,558 | A | 8/1995 | Bergmann et al. | 162/135 |
| 6,547,929 | B2 | 4/2003 | Bobsein et al. | 162/135 |
| 6,825,252 | B2 | 11/2004 | Helbling et al. | |
| 6,833,025 | B2 | 12/2004 | Håkansson et al. | |
| 7,435,473 | B2 * | 10/2008 | Anttila et al. | 428/212 |

FOREIGN PATENT DOCUMENTS

| | | | |
|---|---|---|---|
| EP | 0 770 493 | | 5/1997 |
| EP | 0770493 | * | 5/1997 |
| EP | 1 146 171 | | 10/2001 |
| GB | 1499235 | | 1/1978 |

* cited by examiner

*Primary Examiner* — Leszek Kiliman
(74) *Attorney, Agent, or Firm* — Drinker, Biddle & Reath

(57) ABSTRACT

The present invention relates to improvement in printability of coated paper by adding composition comprising granular starch onto the paper, said composition being essentially free of mineral or synthetic pigment.

9 Claims, No Drawings

COMPOSITION FOR IMPROVING THE PRINTABILITY OF COATED PAPER

The present invention relates to improved printability of coated paper in the sense of e.g. reduced ink-demand, lower ink rub-off and higher delta gloss.

Paper is coated with coating colour mainly to improve printing properties. The relatively rough surface of a base paper is smoothened by coating it with layer(s) containing mineral or synthetic pigment and binder. The coated paper is then dried to a suitable moisture level and usually calendered. Pigment coating improves paper properties such as brightness, opacity, gloss and smoothness all contributing to the quality of printing.

High gloss and smoothness are not always desirable. Too glossy paper may result in that the printed image or text does not distinguish enough from the background as the so called delta gloss (the difference in gloss between printed and unprinted area) is too low. Too smooth surface may cause rub-off problem in printing as the ink does not absorb/adhere fast enough to the paper. There are some solution alternatives to make the surface more dull or matt, e.g. matt (silk) calandering or coating colour pigment selection. Ink rub-off is problem also with matt coated paper.

In EP-A1-770493 ink jet recording material is made by forming an ink-receiving layer on at least one surface of a support sheet. The support sheet is made by melt-laminating a polyolefin resin, which may contain white pigment, on a surface of a natural pulp-containing paper sheet. The ink-receiving layer contains water-soluble resin and colloidal pigment particles.

In GB-1499235 a sheet of paper is coated with a composition comprising a latex of rubbery film-forming polymer having a total solids content of more than 40 wt-% and ungelatinized starch granules in an amount 0.25 to 25 parts by weight per 1.0 parts by weight of latex solids, said granules having an average diameter smaller than the average interstitial distance between the surface fibres of the paper.

In EP-A1-1146171 the delta-gloss of paper having surface roughness less than 6 microns and surface gloss of 5-80% is improved by coating it with a light-weight top coat with sheet gloss 50% or less. The top coat comprises rheology modifier/binder component and pigment or binder coated pigment having average particle diameter of 200 to 2000 nm. The top-coat is partial mono-layer of the pigment particles or clusters thereof.

In U.S. Pat. No. 5,439,558 paper or cardboard is coated with a coat containing ungelatinized starch granules, kaolin, optionally additional mineral pigment and a binder. The proportions are: starch granules 2 to 25% , binder less than 12% and kaolin at least 60% by weight to the total coating pigment. The objective is to reduce occurrence of missing dots in intaglio or rotogravure printing by better coat coverage of the surface.

In U.S. Pat. No. 5,314,753 matt printing paper is produced by coating composition containing 25 to 70% by weight of calcium carbonate as coating pigment, 10 to 65% by weight of ungelatinized starch granules and no more than 15% by weight of a binding agent. The objective is to make a matt coated printing paper which will have an improved scrub resistance and less sensitivity to glossy streaking.

In US-B2-6825252 coating composition comprises a pigment such as clay, calcium carbonate, calcium sulfoaluminate (satin white), talc, titanium dioxide, barium sulphate, silica or plastic pigments and as binder a starch dispersion of discrete crosslinked native starch particles in the range of 200 nm to 100 μm. The dispersion is prepared by extruding a mixture of crosslinked starch and an aqueous liquid in the presence of a hydroxylic liquid. The composition may also contain synthetic latex and additional ingredients usually comprised in coating colours such as foam control agents, optical brightening agents, rheology additives, wetting agents, crosslinking agents, surfactants, lubricants, dispersing agents and dyes.

In US-B2-6833025 matt or silk coated paper is made with a coating composition comprising at least 65% calcium carbonate as mineral pigment and 0.5 to 9.5 weight-% organic particles calculated on the mineral pigment, said particles being starch or paraffin wax in the size of 2 to 50 μm. The objective is to decrease ink scuff tendency considerably at the same time as a good print gloss is achieved. The coated paper is especially well adapted to be used in offset printing techniques.

It is an object of the invention to present a novel composition and method to improve the printability of coated paper. The coated paper may be glossy or dull (silk coated, matt coated). This improvement may arise e.g. in higher delta gloss (especially for glossy paper), lower ink demand or lower ink rub-off (especially for matt coated paper). Higher delta gloss may result from that the gloss of the printed area is increased and/or the gloss of the unprinted area is decreased.

The invention presents a coating composition comprising granular starch, said composition being essentially free of mineral or synthetic pigment. It is surprising that such a composition when applied to a coated paper results in improved printing performance as the prior art solutions always have started from the pigment as essential component.

The coating composition is applied to the coated paper in low solid content, preferably not above 30%, more preferably from 1 to 20% and most preferably from 3 to 15%.

The amount of composition is typically 0.1 to 3 g/m$^2$, preferably 0.2 to 2 g/m$^2$ and more preferably 0.3 to 0.8 g/m$^2$, on one side of the paper, although other amounts are possible.

The starch granules may origin from any suitable source, e.g. from potato, tapioca, wheat, corn, waxy-corn or oats, preferably from potato or wheat. The number average particle size (diameter) of the granules is typically from 5 to 100 μm, preferably from 10 to 80 μm, more preferably from 15 to 60 μm and most preferably from 20 to 50 μm. The starch granules are preferably unmodified but may also be modified, e.g. crosslinked, stabilised, depolymerised, esterified or etherified. The starch granules can be cationic or anionic.

As starch is in the form of discrete particles, a binder is needed to adhere them together and to the paper surface. Usual coating colour binder may be used, e.g. polymer dispersion such as styrenene butadiene, styrene acrylate or polyvinyl acetate latex, or polymer solution such as polyvinyl alcohol. Preferably the binder is styrene butadiene latex. The amount of the binder is typically from 1 to 20, preferably from 2 to 10 and more preferably from 3 to 7 parts for each 100 parts by weight of starch granules.

Rhelogy modifier is usually needed in the composition to stabilise it, i.e. to avoid starch granules to sedimentate. The amount of the the rheology modifier is typically from 5 to 50, preferably from 8 to 40, more preferably from 10 to 30 and most preferably from 15 to 25 parts for each 100 parts by weight of starch granules. Suitable rheology modifier is e.g. guar gum, carboxymethyl cellulose (CMC) and alkali-soluble or -swellable emulsion acrylic copolymer. The pH of the coating composition is adjusted to 8-10, preferably to about 9, with e.g. NaOH in order to optimize the function of the rheology modifier.

The composition may contain small amounts of mineral or synthetic pigment, typically below 20, preferably below 10 and and more preferably below 5 parts for each 100 parts by weight starch granules. However, most preferably the composition is free of such pigment.

The composition may also contain other additives such as optical brightening agent, crosslinking agent such as glyoxal or ammonium zirconium carbonate and lubricant such as calcium stearate.

The base paper comprises fibers which have been released from wood material (e.g. spruce pine, birch or eucalyptus) by mechanical or chemical means or combination thereof. Part or all of the fiber may be of recycled type. The base paper can also contain filler (e.g. calcium carbonate, clay, talc or chalk) and the usual additives and adhesives such as agents for dry/wet strength, drainage/retention and hydrophobicity. The grammage of the base paper may be any suitable for printing, e.g. dry weight of 30 to 200 g/m$^2$, preferably 40 to 100 g/m$^2$. Thus the definition paper includes here also grades that are usually categorized to paperboard or cartonboard. The base paper is produced preferably in usual papermaking manner. Usually the base paper is dried to 10% moisture content and calandered on the paper machine. Thus the base paper could be e.g. typical base paper for light weight coating (so called LWC base paper) or standard woodfree base paper (so called fine paper).

The base paper is coated at least once (first coating or precoat) before application of the composition according to the invention (second coating or topcoat). The precoat may be applied in a usual manner by technology including blade, film or roll transfer, spray and curtain coating. The coating can take place at the end of the paper machine (on-line coating) or on a separate coating machine (off-line coating). The coating colour comprises mineral (e.g. calcium carbonate, clay, talc or chalk) or synthetic pigment and binder (e.g. starch or styrene butadiene latex) and may contain some of the usual coating ingredients. The amount of coating may be 5 to 20 g/m$^2$ on one side of the paper, although other amounts are possible. The coated paper is dried to a suitable moisture level, usually lower than 10%, and may be calandered thereafter.

The composition of the invention is applied onto the coated base paper. There are many suitable application methods for this purpose, e.g. blade, film or roll transfer, curtain and spray coating. Even spray bars could be usable as it is not always necessary to even out the composition layer. The web is usually dried to under 10% before applying the composition. However, some coating techniques, e.g. spray and curtain coating, allow to apply the composition before the first coating (precoat) has been dried and even with the same coating unit. The composition can also be applied in connection with calandering of the coated base paper. As the web is possibly dampened in connection with calandering, the existing moistening arrangement could be used for applying the composition at the same time.

The coating and the composition may be applied to only one side of the paper but it is more common to process both sides which even can take place simultaneously.

The paper according to the invention may be printed by technologies including offset, intaglio or (roto)gravure, inkjet and electrophotography. The preferred printing method is offset as there the invention benefits most of all, e.g. in the sense of delta gloss, ink demand and especially ink rub-off.

The invention works extremely well in the following circumstances and results in a paper with improved printing properties. Base paper of 60 g/m$^2$ dry weight is produced from stock comprising 60% mechanical pulp (spruce) and 40% chemical pulp (pine) and usual adhesives and additives on a paper machine in traditional manner, dried to moisture content of 8% and calandered. This base paper is blade coated with a coating colour dispersion of 62% dry weight to produce a layer of 10 g/m$^2$ dry weight comprising equal amounts of clay and ground calcium carbonate (GCC) pigment, 12 parts (pph) styrene butadiene (SB) latex per 100 pph of the pigment and small amounts of usual coating colour additives. The coated paper is dried to moisture content of 8% and soft calandered. The aqueous composition according to the invention in 7% dry weight is applied to the coated base paper in amount of 1 g/m$^2$ dry weight by film transfer coater. The composition contains 100 pph unmodified granular potato starch with average particle diameter of 35 μm, 23 pph alkali-soluble emulsion acrylic copolymer and 5 pph styrene butadiene (SB) latex. Then the paper is dried to moisture content of 6% and calandered to 30% gloss. Finally, the paper is offset printed.

EXAMPLES

The following examples illustrate the invention, without intending to be restrictive in nature; parts and percentages are by dry weight, unless otherwise indicated.

Example 1

Three coating colours were applied on base paper in amount of 10 g/m$^2$ by blade coater with coating speed of 1300 m/min. The difference was in the pigment selection (clay or ground calcium carbonate pigment) as all other components (e.g. latex, rheology modifier and optical brightener) were the same. Glossy clay used is a special kind of clay of small particles for glossy papers with about 90% of the particles less than 0.5 μm. Steep ground calcium carbonate (GCC) is sieved from normal distribution of particles and the particles are nearly one size without small and large fragments. The coated papers were dried to 5% moisture content and left uncalendered.

A small amount (0.5 g/m$^2$) of composition according to the invention was applied to the coated papers by film transfer coater in a speed of 1000 m/min. The composition contained 100 pph granular potato starch with average particle diameter of 41 μm, 4 pph styrene butadiene latex and 20 pph rheology modifier in water solution with solid content of 5%. The papers were again dried to 5% moisture content.

Half of the coated reels were then soft calandered to low gloss and the other part was left uncalandered. Commercial matt calandered coated paper from a paper mill was used as reference. The uncalendered papers had lower smoothness than the reference but the calendered were on the same level.

Two separate experiments were performed with both calandered and calandered papers. In the first experiment, the papers were printed (B100, black 100% coverage) to ink density 1.4 and the required ink amount was measured. In the second experiment, ink density 1.75 was used and gloss (75°) for unprinted and printed area was determined. The parameters and results (calendered/uncalendered) are gathered in the following table:

| | Paper A | Paper B | Paper C | Reference | |
|---|---|---|---|---|---|
| Glossy clay | | | 50 | | pph |
| Normal clay | 30 | 40 | | | pph |
| Steep GCC | 70 | | 50 | | pph |
| Normal GCC | | 60 | | | pph |
| SB latex (Tg 30° C.) | 11.5 | 11.5 | 11.5 | | pph |
| Ink demand * | 1.20/1.22 | 1.15/1.19 | 1.20/1.27 | 1.41 | g/m$^2$ |
| Gloss (unprinted) ** | 43/39 | 44/39 | 40/31 | 31 | % |
| Gloss (printed) ** | 74/69 | 73/65 | 73/63 | 58 | % |

* ink density 1.4

** ink density 1.75 (both with B100, black 100% coverage)

Both uncalendered and calendered papers according to the invention have clearly lower ink demand than the reference mill paper. Also printed gloss is better, especially for the calandered paper.

Example 2

Three coating colours were applied on base paper in amount of 10 g/m$^2$ by blade coater with coating speed of 1200 m/min. The difference was in the pigment selection and type of SB latex as all other components (e.g. rheology modifier, optical brightener, etc.) were the same. The coated papers were dried to 5% moisture content and calendered.

A small amount (0.5 g/m$^2$) of composition according to the invention was applied to the coated papers by film transfer coater in a speed of 1000 m/min. The composition contained 100 pph granular potato starch with average particle diameter of 41 μm, 4 pph styrene butadiene latex and 20 pph rheology modifier in water solution with solid content of 5%. The papers were again dried to 5% moisture content. The surface of paper was less glossy and not as smooth as before.

Commercial matt calandered coated paper from a paper mill was used as reference.

The papers were printed (B100, ink density 1.75) and gloss (75°) for printed area was determined as well as ink rub-off. The parameters and results are gathered in the following table:

| | Paper A | Paper B | Paper C | Reference | |
|---|---|---|---|---|---|
| Glossy clay | 50 | | | | pph |
| Normal clay | | 20 | 30 | | pph |
| Steep GCC | 50 | 80 | | | pph |
| Normal GCC | | | 70 | | pph |
| SB latex (Tg 30° C.) | 11.5 | 11.5 | | | pph |
| SB latex (Tg 10° C.) | | | 12.0 | | pph |
| Gloss (printed) | 64 | 73 | 73 | 58 | % |
| Ink rub-off | 2.7 | 1.6 | 0.9 | 4.4 | |

Printed gloss is much better than the mill paper has. Ink rub-off is clearly improved.

Example 3

Coating colour containing glossy clay 40 pph, steep calcium carbonate 60 pph and SB latex 11.5 pph was applied on base paper in amount of 10 g/m$^2$ by blade coater with coating speed of 1300 m/min and dried to 5% moisture content.

0, 0.5 g/m$^2$ and 2 g/m$^2$ of composition according to the invention was applied to the coated paper by film transfer coater in a speed of 1000 m/min. The composition contained 100 pph granular potato starch with average particle diameter of 41 μm, 4 pph styrene butadiene latex and 20 pph rheology modifier in water solution with solid content of 10% and pH 9. The papers were again dried to 5% moisture content and run via a machine calendar with roll temperature 40° C. and nip pressure 60 kN/m.

The following properties were measured: L&W air permeability, picking and delamination (IGT 1.5 m/s middle viscosity oil), Emtec (hydrophobicity) and gloss (4 colour black) unprinted/printed after 500 copies printing. The results are gathered in the following table:

| Amount of composition | 0 | 0.5 | 2 | g/m$^2$ |
|---|---|---|---|---|
| L&W air permeability | 7.25 | 4.88 | 4.73 | ml/min |
| Picking | 0.54 | 0.68 | 1.02 | m/s |
| Delamination | 1.28 | 1.26 | — | m/s |

-continued

| | | | | |
|---|---|---|---|---|
| Emtec at 5/10/15 second | 34/12/6 | 58/30/13 | 65/38/21 | % |
| Gloss unprinted/printed | 22.9/45.4 | 22.6/47.4 | 19.7/42.1 | % |
| Smoothness unpr./printed | 4.49/4.15 | 4.84/4.30 | 6.60/5.90 | μm |

These results show that the invention lowers air permability, improves dry surface strength, increases hydrophobicity and elevates smoothness of the paper.

The invention claimed is:

1. A coating composition for improving printability of coated paper comprising granular starch, rheology modifier and at least one binder, said composition containing less than 20 parts by weight of mineral or synthetic pigment for each 100 parts by weight of starch granules, wherein the granular starch has average particle diameter of about 5 to about 100 μm.

2. The coating composition according to claim 1, wherein the binder is a polymer dispersion of styrene butadiene latex or a polymer solution of polyvinyl alcohol.

3. The coating composition according to claim 1, wherein the rheology modifier is guar gum, carboxymethyl cellulose (CMC) or alkali-soluble or -swellable emulsion acrylic copolymer or any mixture of these.

4. A method for improving printability of coated paper by applying a coating composition comprising at least one binder onto said coated paper, wherein the composition contains granular starch and rheology modifier, said composition containing less than 20 parts by weight of mineral or synthetic pigment for each 100 parts by weight of starch granules, and wherein the composition is applied in amount of about 0.1 to about 3 g/m$^2$.

5. The method according to claim 4, wherein the coating composition is applied by film/roll transfer, spray, curtain or blade coating.

6. Paper comprising a first coating (precoat) containing mineral or synthetic pigment and at least one binder and a second coating (topcoat) containing at least one binder, wherein the second coating comprises granular starch and rheology modifier, said second coating containing less than 20 parts by weight of mineral or synthetic pigment for each 100 parts by weight of starch granules, and wherein the granular starch has average particle diameter of about 5 to about 100 μm.

7. The paper according to claim 6, wherein the starch is from potato, tapioca, wheat, corn, waxy-corn or oats.

8. A method of offset printing comprising the steps of applying to paper a coating composition comprising at least one binder wherein the composition contains granular starch and rheology modifier, said composition containing less than 20 parts by weight of mineral or synthetic pigment for each 100 parts by weight of starch granules, and wherein the granular starch has average particle diameter of about 5 to about 100 μm.

9. The method according to claim 8, wherein the starch is from potato, tapioca, wheat, corn, waxy-corn or oats.

* * * * *